US010605517B2

(12) United States Patent
Eicher et al.

(10) Patent No.: US 10,605,517 B2
(45) Date of Patent: Mar. 31, 2020

(54) REFRIGERATION APPLIANCE COMPRISING A DELIVERY DOOR

(71) Applicant: BSH HAUSGERAETE GMBH, Munich (DE)

(72) Inventors: Max Eicher, Munich (DE); Christoph Becke, Grosskarolinenfeld (DE); Christine Hartwein, Nandlstadt (DE); Boris Angele, Diessen (DE)

(73) Assignee: BSH hausgeraete GmbH, Munich (DE)

( * ) Notice: Subject to any disclaimer, the term of this patent is extended or adjusted under 35 U.S.C. 154(b) by 0 days.

(21) Appl. No.: 15/744,547

(22) PCT Filed: Jun. 24, 2016

(86) PCT No.: PCT/EP2016/064677
§ 371 (c)(1),
(2) Date: Jan. 12, 2018

(87) PCT Pub. No.: WO2017/016767
PCT Pub. Date: Feb. 2, 2017

(65) Prior Publication Data

US 2018/0202705 A1 Jul. 19, 2018

(30) Foreign Application Priority Data

Jul. 24, 2015 (DE) ..... 10 2015 214 024

(51) Int. Cl.
*F25D 23/02* (2006.01)
*F25D 23/12* (2006.01)
(Continued)

(52) U.S. Cl.
CPC ..... *F25D 23/025* (2013.01); *B67D 3/0009* (2013.01); *F25D 23/028* (2013.01);
(Continued)

(58) Field of Classification Search
CPC .... F25D 23/025; F25D 23/028; F25D 23/126; F25D 27/00; F25D 2323/023; B67D 3/0009
(Continued)

(56) References Cited

U.S. PATENT DOCUMENTS

2005/0177481 A1* 8/2005 Crisp, III ..... B67D 1/0057 705/34
2010/0170279 A1* 7/2010 Aoki ..... F25D 11/02 62/264
(Continued)

FOREIGN PATENT DOCUMENTS

EP 2131123 A2 * 12/2009 ..... F25C 5/182
EP 2444761 A2 4/2012
(Continued)

*Primary Examiner* — Joseph F Trpisovsky
(74) *Attorney, Agent, or Firm* — Laurence A. Greenberg; Werner H. Stemer; Ralph E. Locher

(57) ABSTRACT

A refrigeration appliance includes a refrigerated inner space and a refrigeration appliance door for closing the refrigerated inner space. The refrigeration appliance door includes a dispenser area with a drink dispenser device on an exterior of the refrigeration appliance door. The refrigeration appliance door has a dispenser door and the dispenser door is constructed to close the dispenser area.

19 Claims, 3 Drawing Sheets

(51) Int. Cl.
*B67D 3/00* (2006.01)
*F25D 27/00* (2006.01)

(52) U.S. Cl.
CPC ..... *F25D 23/126* (2013.01); *F25D 27/00* (2013.01); *F25D 2323/023* (2013.01)

(58) Field of Classification Search
USPC ..... 62/389
See application file for complete search history.

(56) References Cited

U.S. PATENT DOCUMENTS

| | | | | |
|---|---|---|---|---|
| 2012/0031136 | A1* | 2/2012 | Park | F25D 11/02 62/340 |
| 2012/0096872 | A1* | 4/2012 | Cheong | F25D 23/025 62/3.3 |
| 2012/0180517 | A1* | 7/2012 | Filho | B67D 1/0003 62/389 |
| 2012/0216560 | A1* | 8/2012 | Kim | F25D 23/126 62/340 |

FOREIGN PATENT DOCUMENTS

| | | | |
|---|---|---|---|
| KR | 20040049673 | A | 6/2004 |
| KR | 1020070096516 | A | 10/2007 |
| WO | 9901704 | A2 | 1/1999 |
| WO | 2008007916 | A1 | 1/2008 |
| WO | 2011003161 | A2 | 1/2011 |

* cited by examiner

REFRIGERATION APPLIANCE COMPRISING A DELIVERY DOOR

BACKGROUND OF THE INVENTION

Field of the Invention

The present invention relates to a refrigeration appliance with a dispenser door.

Traditional refrigeration appliances frequently have drink dispenser devices for the serving of drinks, such as for example liquids or ice, so that the user of the refrigeration appliance has liquids, such as for example water or ice for the cooling of drinks, at their disposal. The drink dispenser devices are customarily arranged in a visible manner on an exterior of the refrigeration appliance door of the refrigeration appliance, in order to enable the user to enjoy advantageous access to the drink dispenser device from the front of the refrigeration appliance. A drink dispenser device not separated from the external space of the refrigeration appliance may not be desirable to the user of the refrigeration appliance, as for example dirt can be deposited on the drink dispenser device.

SUMMARY OF THE INVENTION

It is the object of the present invention to specify a refrigeration appliance with a drink dispenser device which is separated from the external space of the refrigeration appliance.

This object is achieved by a subject matter with the features according to the independent claim. Advantageous embodiments are the subject matter of the dependent claims, the description and the drawings.

According to one aspect, the inventive object is solved by a refrigeration appliance with a refrigerated inner space and a refrigeration appliance door for closure of the interior of the refrigerator, wherein the refrigeration appliance door has a dispenser area with a drink dispenser device on the exterior of the refrigeration appliance door, wherein the refrigeration appliance door has a dispenser door, wherein the dispenser door is embodied to close the dispenser area.

The technical advantage is thereby for example achieved that effective closure of the dispenser area and thus an effective separation of the drink dispenser device from the external area of the refrigeration appliance are ensured by means of the dispenser door.

The drink dispenser device can in particular comprise a device for the dispensing of liquids and/or ice. The drink dispenser device enables the user of the refrigeration appliance to remove drinks, such as for example liquids and/or ice, from the refrigeration appliance and to use them for example to cool a drink. As the drink dispenser device is arranged on the exterior of the refrigeration appliance door of the refrigeration appliance, and is thus accessible from the front of the refrigeration appliance, the dispenser door can separate the drink dispenser device from the external area of the refrigeration appliance during normal operation of the refrigeration appliance. Because of a multiplicity of various operating elements of the drink dispenser device, the drink dispenser device gives rise to a complexity of the visual appearance, which can be eliminated through a separation of the dispenser areas by means of the dispenser door. When utilizing the drink dispenser device, the user can open the dispenser door, in order to gain access to the drink dispenser device. The drink dispenser device is thus accessible from the external area of the refrigeration appliance via the dispenser door.

The dispenser area enables the user to obtain drinks dispensed by the drink dispenser device, such as for example liquid and/or ice, in a simple and advantageous manner. The dispenser area is arranged on the exterior of the refrigeration appliance door and can for example comprise a recess or a compartment, in which for example a glass or a carafe can be placed. If the user places a glass or a carafe in the dispenser area and positions it in an advantageous manner in relation to the drink dispenser device arranged in the dispenser area, the user can then effectively obtain liquid and/or ice via the drink dispenser device.

In addition, improved heat insulation of the interior of the refrigerator from the external area of the refrigeration appliance can be ensured by means of the arrangement of the dispenser door on the refrigeration appliance door.

A refrigeration appliance means in particular a household refrigeration appliance, that is to say a refrigeration appliance which is employed for housekeeping purposes in homes or in the gastronomy sector, and in particular serves to store foodstuffs and/or drinks at particular temperatures, such as for example a refrigerator, a freezer, a fridge/freezer combination, a chest freezer or a wine cooling cabinet.

In one advantageous embodiment of the refrigeration appliance, the dispenser door has an at least partially translucent section, in order to allow viewing of the dispenser area with a closed dispenser door.

The technical advantage is thereby achieved, that by means of the at least partially translucent section of the dispenser door, light from outside the refrigeration appliance can penetrate into the dispenser area and illuminate the dispenser area and the drink dispenser device. The user is thereby enabled to see into the dispenser area even in the case of a closed dispenser door. The user can thereby, for example, see an indicator of the drink dispenser device, in order in particular to check the fill-level of the drink to be dispensed, such as for example liquid and/or ice, in the drink dispenser device.

In a further advantageous embodiment of the refrigeration appliance, the at least partially light-transparent section is formed from a translucent material, in particular from at least partially light-transparent glass or at least partially light-transparent plastic.

The technical advantage is thereby achieved, that by means of the use of the specified materials, an at least partially light-transparent section with advantageous properties can be made available. In the case of a completely or almost completely translucent section, the material has a low level of light absorption, so that a great amount of light can penetrate the translucent section of the dispenser door, in order to guarantee adequate illumination of the dispenser area. The at least partially light-transparent section can also be only partially light-transparent, and for example be embodied as a matte light-transparent section, which guarantees complete visual transparency and thereby enables the dispenser area and the drink dispenser device to be at least partially concealed behind the dispenser door, or enables only a blurred perception of the drink dispenser device on the part of the user. The at least partially light-transparent section can in particular be formed from a colored translucent material, in order to guarantee a pleasing colored illumination of the dispenser area and the drink dispenser device.

In one advantageous embodiment of the refrigeration appliance, the dispenser area is open towards the refrigerated inner space.

The technical advantage is thereby achieved that the user of the refrigeration appliance can transfer drinks from the dispenser area into the refrigerated inner space with a closed refrigeration appliance door, without having to open the refrigeration appliance door. For example, the user can transfer, for example pass through, drinks or ice dispensed into a drinks receptacle by the drink dispenser device, from the dispenser area into the refrigerated inner space without having to open the refrigeration appliance door for this purpose. This can be of advantage if the user does not immediately consume the drink and/or ice dispensed by the drink dispenser device, but wishes to store it in a chilled condition in the refrigerated inner space.

In one advantageous embodiment of the refrigeration appliance, the drink dispenser device is embodied to dispense liquid and/or ice, in particular water and/or water ice.

The technical advantage is thereby achieved, that by means of the drink dispenser device the user is afforded the selection of a multiplicity of drinks. The drink dispenser device is embodied to dispense a multiplicity of drinks, such as for example juices, soda or water. The drink dispenser device can also comprise an ice-dispenser in order to dispense ice, in particular water ice, by means of which the user of the refrigeration appliance is enabled to cool drinks through the addition of ice.

In one advantageous embodiment of the refrigeration appliance, the refrigeration appliance door has a refrigerated goods compartment on the exterior of the refrigeration appliance door to accommodate goods to be refrigerated, wherein the dispenser door is embodied to close the refrigerated goods compartment, and wherein the refrigerated goods compartment is in particular arranged above the dispenser areas on the exterior of the refrigeration appliance door.

The technical advantage is thereby achieved that the user can simply and advantageously convey goods to be refrigerated into the refrigerated goods compartment. The refrigerated goods compartment can for example comprise a shelf insert, a compartment insert or a home bar, and is closed by the dispenser door. By means of the refrigerated goods compartment, the user has at their disposal an area for the storage of goods to be refrigerated, which is simply and advantageously accessible to the user by opening the dispenser door, without having to open the refrigeration appliance door. In particular, the refrigerated goods compartment can be arranged above the dispenser area on the exterior of the refrigeration appliance door, by means of which the user is afforded advantageous access both to the dispenser area and to the refrigerated goods compartment from the front of the refrigeration appliance.

In a further advantageous embodiment of the refrigeration appliance, the refrigeration appliance door has a hatch, wherein the hatch is arranged between the refrigerated goods compartment and the refrigerated inner space.

The technical advantage is thereby achieved, that the user of the refrigeration appliance can transfer goods to be refrigerated from the refrigerated inner space into the refrigerated goods compartment through the hatch in the refrigeration appliance door, which is arranged between the refrigerated goods compartment and the refrigerated inner space, without having to open the refrigeration appliance door for this purpose. This can be of advantage if the goods to be refrigerated are to be removed promptly from the refrigerated goods compartment. Alternatively, goods to be refrigerated can be transferred from the refrigerated goods compartment into the refrigerated inner space again, if the goods to be refrigerated are not to be removed promptly, and instead are to be stored in the refrigerated inner space for an extended period.

In a further advantageous embodiment of the refrigeration appliance, the refrigeration appliance has a temporary storage element for the depositing of goods to be refrigerated, wherein the temporary storage element is arranged on an inner surface of the refrigeration appliance door, and wherein the temporary storage element is accessible from the exterior of the refrigeration appliance through the hatch with a closed refrigeration appliance door and open dispenser door.

The temporary storage element of the refrigerated goods compartment, which is arranged on an inner surface of the refrigeration appliance door and is accessible from the exterior of the refrigeration appliance through the hatch with a closed refrigeration appliance door and open dispenser door, enables the depositing of goods to be refrigerated in the temporary storage element. The goods to be refrigerated deposited in the temporary storage element are accessible to the user from the exterior of the refrigeration appliance through the hatch, without the refrigeration appliance door needing to be opened.

In a further advantageous embodiment of the refrigeration appliance, the dispenser door comprises a thermally insulating material.

The technical advantage is thereby achieved, that by means of the thermally insulating material, particularly effective heat insulation of the dispenser door in enabled, by means of which a rise in temperature in the refrigerated inner space of the refrigeration appliance can be prevented. For example, insulating glass or insulating plastic can in particular be used as the thermally insulating material. An insulating glass or an insulating plastic is a heat-insulating component made up of at least two sheets of glass or plastic, wherein there is a hollow space between the sheets, which is hermetically sealed, and wherein the hollow space comprises a vacuum or is filled with insulating gas.

In a further advantageous embodiment of the refrigeration appliance, the at least partially light-transparent section comprises more than 50% of the area of the dispenser door, in particular more than 75% of the area of the dispenser door.

The technical advantage is thereby achieved, that by means of the large-area translucent section of the dispenser door, a particularly large area of the dispenser area can be perceived by the user from outside the dispenser door. The user can thereby perceive the drink dispenser device particularly well, and for example also recognize a drinks receptacle which is positioned on the drink dispenser device, in order for example to follow the dispensing process. In particular, the at least partially light-transparent section can comprise the whole surface of the dispenser door.

In a further advantageous embodiment of the refrigeration appliance the dispenser door comprises more than 50% of the area of the refrigeration appliance door, in particular more than 75% of the area of the refrigeration appliance door.

The technical advantage is thereby achieved, that by means of a particularly large-area dispenser door, the dispenser area or the refrigerated goods compartment can be embodied in a particularly large form on the exterior of the refrigeration appliance door. In particular, the dispenser door can comprise the whole area of the refrigeration appliance door.

In a further advantageous embodiment of the refrigeration appliance, the drink dispenser device has at least one dispensing element to dispense a drink, wherein the drink dispenser device in particular comprises a retaining element to retain a drinks receptacle.

The technical advantage is thereby achieved, that by means of the dispensing element, for example the paddle, a particularly advantageous dispensing of drinks, such as for example liquid and/or ice, by the drink dispenser device is enabled. The drink dispenser device can in particular have a multiplicity of dispensing elements, which are embodied to dispense different types of drinks, such as for example liquids or ice. The user of the refrigeration appliance thereby has at their disposal a multiplicity of different drinks, or types of liquid and/or ice. The drink dispenser device can in particular comprise a retaining element, for example a bracket or drip-tray, to accommodate a drinks receptacle to contain drink, for example liquid and/or ice.

In a further advantageous embodiment of the refrigeration appliance, the dispensing element comprises an activation element to initiate the dispensing of a drink, wherein the dispensing element is embodied to dispense a drink upon actuation of the activation element.

The technical advantage is thereby achieved that upon actuation, for example by touching or pressing the activation element, such as for example a push-button, a drink, such as for example liquid and/or ice, can be dispensed by the dispensing element. The type and quantity of the dispensed drink can thereby be controlled by the user.

In a further advantageous embodiment of the refrigeration appliance, the refrigeration appliance comprises a storage container to accommodate a drink, in particular liquid and/or ice, wherein the storage container is connected with the drink dispenser device by means of a dispensing line.

The technical advantage is thereby achieved, that by means of the storage container the accommodation of a sufficient amount of drink in the refrigeration appliance is provided for, which guarantees that an adequate quantity of drink is always available to the user. The storage container can in particular comprise a mixer device for mixing liquid and/or an ice-maker device to create ice. The storage container can in particular be arranged on the back of the interior of the refrigerator and the dispensing line can in particular extend from the back of the interior of the refrigerator to the refrigeration appliance door. The storage container is connected to the drink dispenser device by the dispensing line, by means of which drink can be effectively fed from the storage container of the drink dispenser device.

In a further advantageous embodiment of the refrigeration appliance, the refrigeration appliance comprises a feed line to feed a drink from the external area of the refrigeration appliance to the drink dispenser device.

The technical advantage is thereby achieved, that by means of the feed line, which is connected with the drink dispenser device, direct feeding of drink from the external area of the refrigeration appliance to the drink dispenser device is possible. The feed line can in particular comprise a water feed line, which is connected to a water supply point of the refrigeration appliance, in order to ensure the effective feeding of water to the drink dispenser device of the refrigeration appliance.

In a further advantageous embodiment of the refrigeration appliance, the refrigeration appliance door comprises a lighting unit for illumination of the dispenser area, wherein the lighting unit is integrated into the at least partially translucent section of the dispenser door or at least surrounds the partially translucent section and in particular comprises an LED- or OLED-layer.

The technical advantage is thereby for example achieved that the user of the refrigeration appliance can see into the dispenser area from outside the refrigeration appliance through the at least partially translucent section via the dispenser door, without having to open the dispenser door. The lighting unit can in particular be embodied as a standard lighting unit, which is employed in traditional refrigeration appliances. The lighting unit can in particular comprise a light-emitting diode or an arrangement of light-emitting diodes, such as for example an LED or an OLED. The lighting unit, in particular an LED or OLED, which is arranged on the refrigeration appliance door, enables effective illumination of the dispenser area and of the exterior of the refrigeration appliance. The user of the refrigeration appliance can thus see into the dispenser area even in the case of a lack of external lighting, for example in a dark room, through the at least partially translucent section of the dispenser door.

In a further advantageous embodiment of the refrigeration appliance, the refrigeration appliance comprises an interior lighting unit for illumination of the interior of the refrigerator, wherein the dispenser area has at least one further translucent section, which is arranged towards the refrigerated inner space, in order to illuminate the dispenser area by means of the interior lighting unit.

The technical advantage is thereby for example achieved that the dispenser area, which has a further translucent section, is advantageously illuminated by the interior lighting. Because of the interior lighting, which enables illumination of the dispenser area, the user can see into the dispenser area through the at least partially translucent section of the dispenser door from outside the refrigeration appliance via the dispenser door, without the dispenser door having to open. The further lighting unit can in particular be embodied as a standard lighting unit, which is employed in traditional refrigeration appliances. The further lighting unit can in particular comprise a light-emitting diode or an arrangement of light-emitting diodes, such as for example an LED or an OLED.

In a further advantageous embodiment of the refrigeration appliance, the refrigeration appliance door comprises a dispenser door frame, wherein the dispenser door is arranged in the dispenser door frame, and wherein the dispenser door frame comprises a seal.

The technical advantage is thereby achieved, that an effective positioning of the dispenser door in the refrigeration appliance door is attained by means of the dispenser door frame, and that the exchange of heat between the refrigerated inner space and the external area of the refrigeration appliance can be reduced by means of the seal.

In a further advantageous embodiment of the refrigeration appliance, the dispenser door comprises a handle or a push-button for opening the dispenser door.

The technical advantage is thereby achieved that the reach-in door can be simply and effectively opened through the use of the handle or push-button.

BRIEF DESCRIPTION OF THE SEVERAL VIEWS OF THE DRAWING

Further exemplary embodiments are explained with reference to the attached drawings. Wherein.

DESCRIPTION OF THE INVENTION

Figure 1:
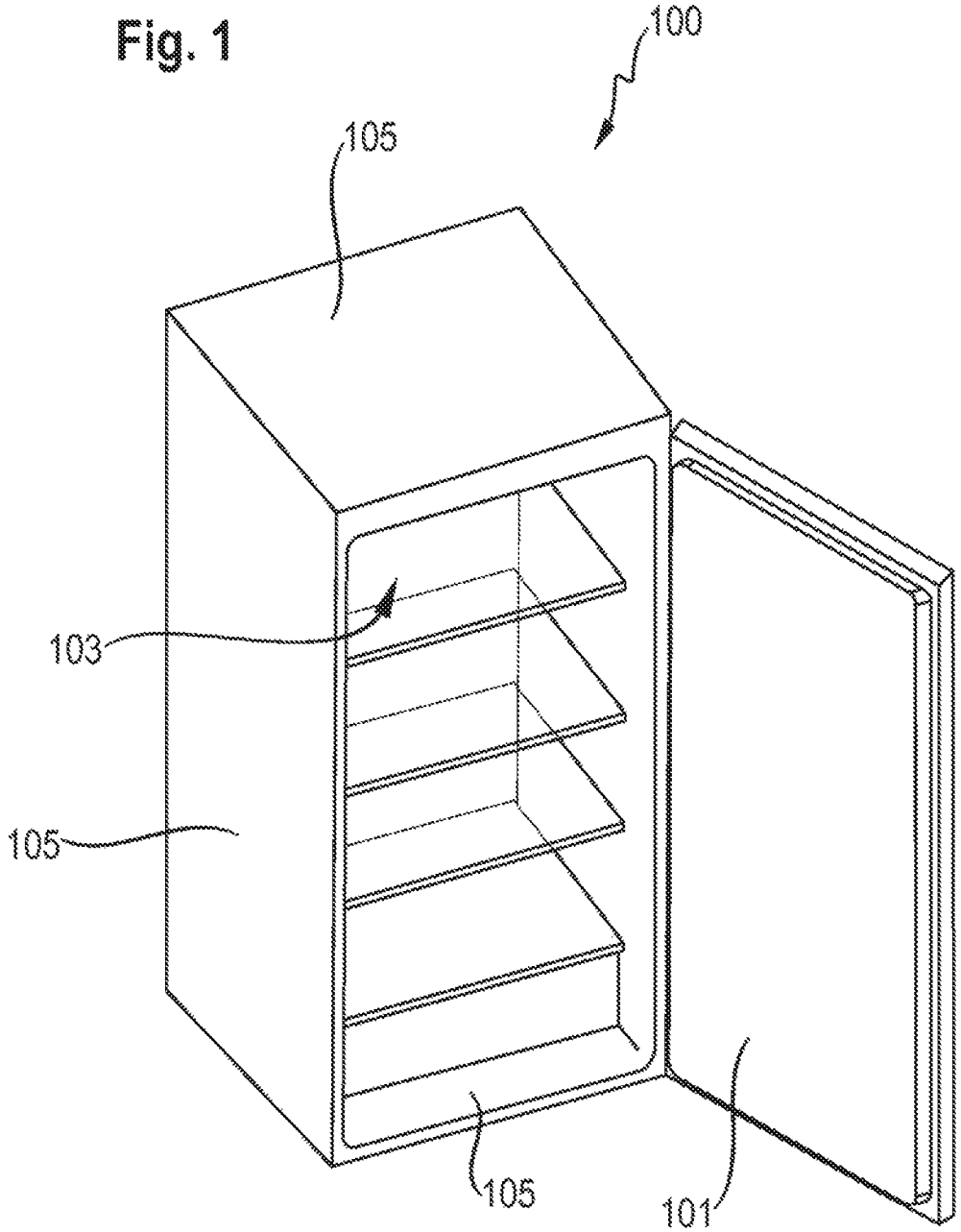
FIG. 1 shows a schematic representation of a refrigeration appliance.

FIG. 1 shows a refrigerator which here represents a generic refrigeration appliance 100 with a refrigeration appliance door 101, by means of which the refrigerated inner space 103 of the general refrigeration appliance 100 can be closed. In FIG. 1 only an inner surface of the refrigeration appliance door 101 is represented, wherein an exterior of the refrigeration appliance door 101 in FIG. 1 is not visible. The refrigerated inner space 103 is delimited by a refrigeration appliance frame 105.

The refrigeration appliance 100 comprises one or more refrigerant circuits with in each case an evaporator, a compressor, a condenser and a throttling device. The evaporator is a heat exchanger, in which after the expansion, the liquid refrigerant is evaporated by means of heat absorption from the medium to be cooled, for example air. The compressor is a mechanically driven component which sucks refrigerant vapor from the evaporator and ejects it to the condenser at higher pressure. The condenser is a heat exchanger, in which after the compression the evaporated refrigerant is condensed by means of the emission of heat to an external cooling medium, for example air. The throttling device is an apparatus for the constant reduction of the pressure by means of cross sectional narrowing. The refrigerant is a fluid which is used for heat transfer in the refrigerant circuit, which in the case of low temperatures and low pressure of the fluid absorbs heat, and in the case of a higher temperature and higher pressure of the fluid gives off heat, wherein changes in the state of the fluid are customarily involved.

Figure 2:
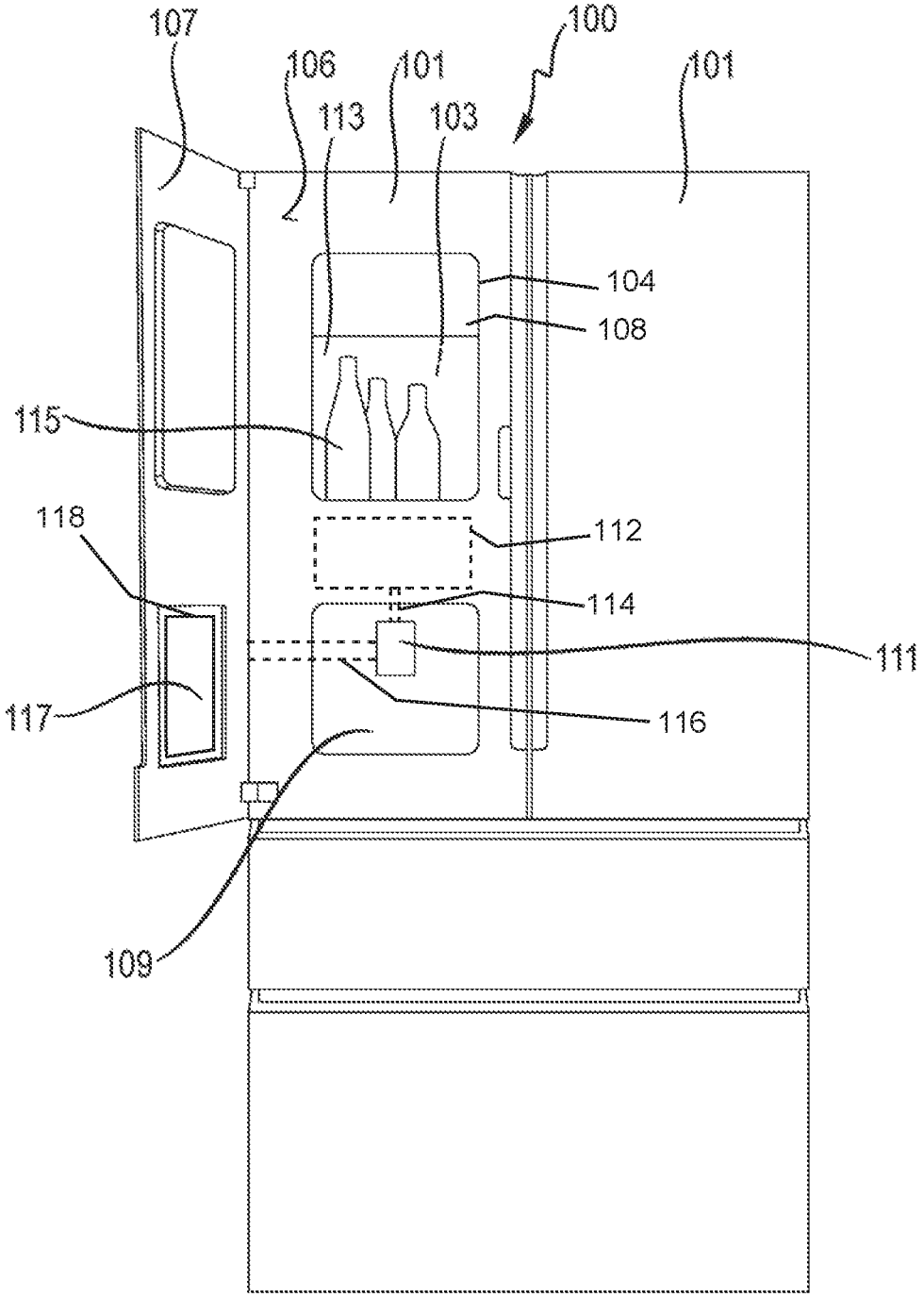
FIG. 2 shows a schematic representation of a refrigeration appliance with a dispenser door on the refrigeration appliance door.

FIG. 2 shows a schematic representation of a refrigeration appliance with a dispenser door on the refrigeration appliance door. The refrigeration appliance 100 comprises refrigeration appliance doors 101, by means of which the refrigerated inner space 103 of the refrigeration appliance 100 is closed. The refrigeration appliance 100 represented in FIG. 2 has a refrigeration appliance door 101 with a dispenser door 107 on an exterior 106 of the refrigeration appliance door 101. The dispenser door 107 can comprise a thermally insulating material, in order to prevent an exchange of heat between the refrigerated inner space 103 and the external area of the refrigeration appliance 100.

The user of the refrigeration appliance 100 can open the dispenser door 107 independently of the refrigeration appliance door 101, in order to gain access to a dispenser area 109, which is arranged on the exterior 106 of the refrigeration appliance door 101. A drink dispenser device 111 is arranged in the dispenser area 109, wherein the drink dispenser device 111 is embodied to dispense drinks, in particular liquid or ice. The user of the refrigeration appliance 100 can position a drinks receptacle in the dispenser area 109 on the drink dispenser device 111. Upon actuation of the drink dispenser device 111 by the user, a drink, in particular liquid or ice, is dispensed through the drink dispenser device 111 into the drinks receptacle and the user can then remove the drinks receptacle with the drink, for example liquid or ice, from the dispenser area 109.

On the exterior 106 of the refrigeration appliance door 101 the refrigeration appliance door 101 further has a refrigerated goods compartment 113, which is arranged above the dispenser area 109. Goods to be refrigerated 115 can be placed in the refrigerated goods compartment 113. In FIG. 2, the refrigerated goods compartment 113 is represented as a home bar, in which drinks receptacles are represented as goods to be refrigerated 115. The refrigerated goods compartment 113 is closed by means of the dispenser door 107. A temporary storage element 108 for the depositing of goods to be refrigerated 115, which is not represented in FIG. 2, can be arranged on an inner surface of the refrigeration appliance door 101 in the refrigerated goods compartment 113, wherein the temporary storage element 108 is accessible from outside the refrigeration appliance 100 through a hatch 104 between the refrigerated goods compartment 113 and the refrigerated inner space 103, with a closed refrigeration appliance door 101 and an open dispenser door 107. An exchange of heat between the refrigerated goods compartment 113 and the refrigerated inner space 103 takes place through the hatch between the refrigerated goods compartment 113 and the refrigerated inner space 103. A cooling of the goods to be refrigerated 115 in the refrigerated goods compartment 113 comes about through the heat exchange.

By means of the refrigerated goods compartment 113 the user has available an area for the storage of goods to be refrigerated 115 and by means of the dispenser area 109 with the drink dispenser device 111 the user is enabled to remove drinks simply and advantageously from the refrigeration appliance 100. By opening the dispenser door 107, both the dispenser area 109 and the refrigerated goods compartment 113 are simply and advantageously accessible, without the user having to open the refrigeration appliance door 101, by means of which a rise in temperature in the refrigerated inner space 103 can be prevented.

The dispenser door 107 has an at least partially translucent section 117. In the case of an almost completely translucent section 117, the user of the refrigeration appliance 100 can see into the dispenser area 109 through the translucent section 117 of the dispenser door 107 and for example determine the status of the drink dispenser device 111. The user can thereby for example track the dispensing of drink by the drink dispenser device 111 in the case of a closed dispenser door 107. The at least partially light-transparent section 117 can alternatively be only partially light-transparent, and for example embodied as a matte light-transparent section 117, which does not guarantee complete visual transparency. The user can thereby only discern the drink dispenser device 111 in a blurred manner.

Figure 3:
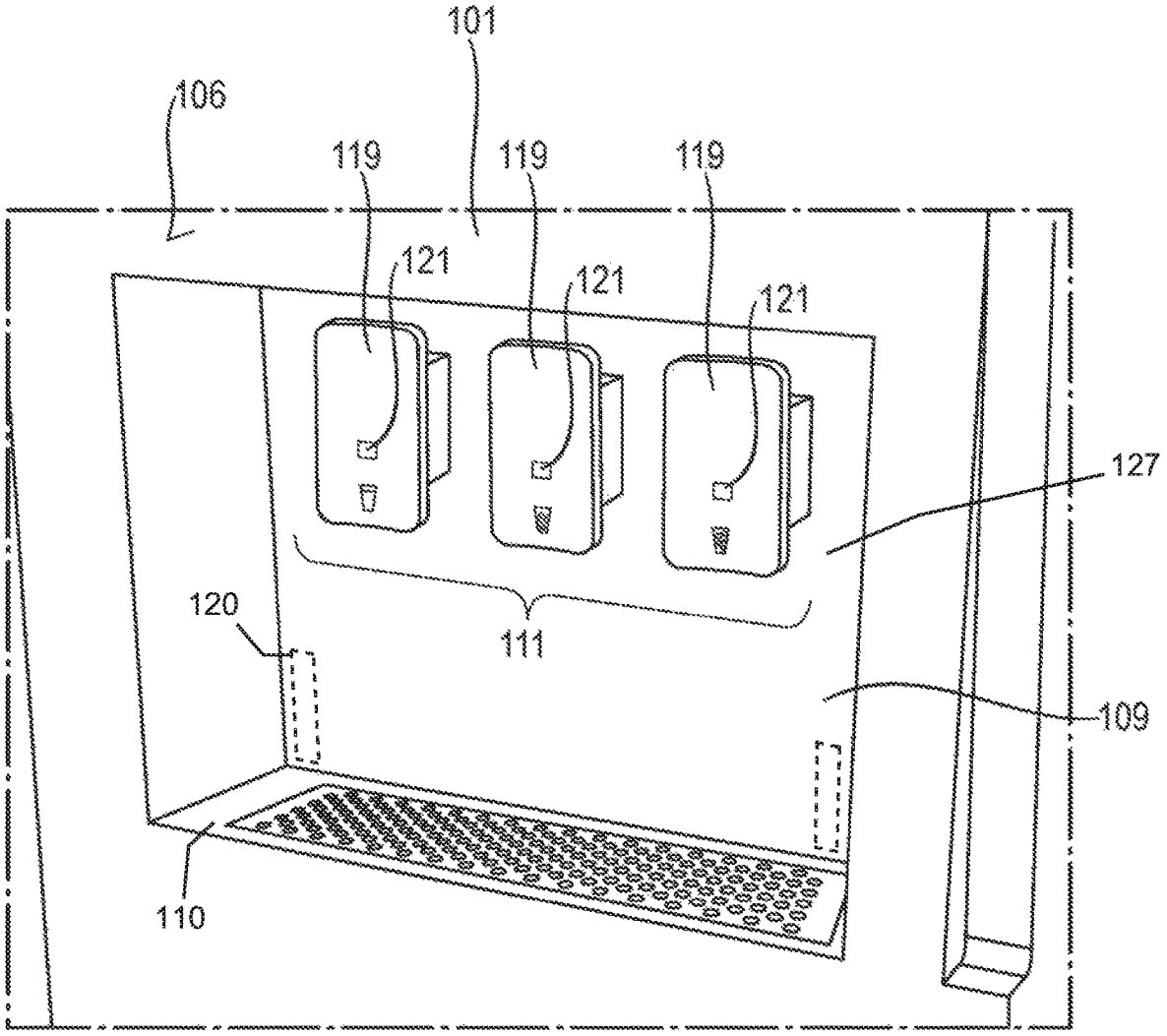
FIG. 3 shows a schematic representation of a dispenser area with a drink dispenser device.

FIG. 3 shows a schematic representation of a dispenser area with a drink dispenser device. In FIG. 3, the dispenser door 107 is opened so that the dispenser area 109 is visible on the exterior 106 of the refrigeration appliance door 101. A drink dispenser device 111 to dispense a drink, in particular liquid or ice, is arranged in the dispenser area 109, wherein the drink dispenser device 111 comprises three dispenser elements 119. The three dispenser elements 119 can be embodied to dispense different types of drinks, in particular liquids and/or ice. In addition, one or more retaining elements 110 to retain a drinks receptacle can be arranged in the dispenser area 109 underneath the drink dispenser device 111. As seen in FIG. 2, the drink dispenser device 111 receives liquid from a storage container 112 through a dispensing line 114 or through a feed line 116 from the outside.

The dispenser elements 119 can have activation elements 121, wherein the respective dispensing element 119 is embodied to dispense a drink, such as for example liquid or ice, upon actuation of the respective element 121. The activation element 121 can for example comprise a push-button.

By means of the inventive dispenser door 107, it is achievable that the dispenser area 109 can be closed, so that the dispenser area 109 and the drink dispenser device 111 arranged therein are not permanently accessible. In that the drink dispenser device 111 is only accessible when the user of the refrigeration appliance 100 opens the dispenser door 107, the use of a dispenser door 107 results in reduced complexity of the exterior design and thus in visual neatness of the refrigeration appliance 100.

An important advantage of the use of a dispenser door 107 is that the depositing of dirt particles in the dispenser area 109 and on the drink dispenser device 111 is avoided, by means of which an impairment of the drink dispenser device 111 can be prevented. In addition a direct access to the drink dispenser device 111 and if applicable to goods to be refrigerated 115 in the refrigerated goods compartment 113 is possible thanks to the dispenser door 107, without the user having to open the refrigeration appliance door 101, by means of which a steep rise of temperature in the refrigerated inner space 103 is avoided.

In the case of almost complete light transparency, the at least partially light-transparent section 117 of the dispenser door 107 enables an advantageous view of the drink dispenser device 111 on the part of the user and advantageous and effective illumination of the drink dispenser device 111 by the light from the external area of the refrigeration appliance 100 or by means of light from a lighting unit 118 on the refrigeration appliance door 101 at the translucent section 117 or from an interior lighting unit 120 arranged in the refrigerated inner space 103 and shining through a further translucent section 127 of the dispenser area 109. In addition, the dispenser door 107 enables advantageous heat insulation of the refrigeration appliance 100, in particular of the refrigeration appliance door 101, if the dispenser door 107 comprises a thermally insulating material.

All features explained and shown in connection with individual embodiments of the invention can be provided in a different combination in the inventive object, in order simultaneously to realize their advantageous effects.

The protective scope of the present invention is provided by the claims and is not limited by the features explained in the description or shown in the figures.

LIST OF REFERENCE NUMBERS

100 Refrigeration appliance
101 Refrigeration appliance door
103 Refrigerated inner space
105 Refrigeration appliance frame
106 Exterior of refrigeration appliance door
107 Dispenser door
109 Dispenser area
111 Drink dispenser device
113 Refrigerated goods compartment
115 Goods to be refrigerated
117 Light-transparent section
119 Dispensing element
121 Activation element

The invention claimed is:

1. A refrigeration appliance, comprising:

a refrigerated inner space;

a refrigeration appliance door for closing said refrigerated inner space, said refrigeration appliance door having an exterior and a dispenser area on said exterior, said refrigeration appliance door having a refrigerated goods compartment disposed on said exterior of said refrigeration appliance door for accommodating goods to be refrigerated;

said dispenser area having a drink dispenser device; and said refrigeration appliance door having a dispenser door for closing said dispenser area and said refrigerated goods compartment, said dispenser door covering an entire area of said appliance door.

2. The refrigeration appliance according to claim 1, wherein said dispenser door has an at least partially translucent section permitting viewing of said dispenser area when said dispenser door is closed.

3. The refrigeration appliance according to claim 2, wherein said at least partially translucent section is formed of a translucent material.

4. The refrigeration appliance according to claim 3, wherein said translucent material is at least partially translucent glass or at least partially translucent plastic.

5. The refrigeration appliance according to claim 1, wherein said dispenser area is open to said refrigerated inner space.

6. The refrigeration appliance according to claim 1, wherein said drink dispenser device is constructed to dispense liquid or ice.

7. The refrigeration appliance according to claim 1, wherein said drink dispenser device is constructed to dispense water or water ice.

8. The refrigeration appliance according to claim 1, wherein said refrigerated goods compartment is disposed above said dispenser area on said exterior of said refrigeration appliance door.

9. The refrigeration appliance according to claim 8, wherein said refrigeration appliance door has a hatch disposed between said refrigerated goods compartment and said refrigerated inner space.

10. The refrigeration appliance according to claim 9, wherein:

said refrigeration appliance door has an inner surface;

a temporary storage for depositing goods to be refrigerated is disposed on said inner surface of said refrigeration appliance door; and said temporary storage is accessible from outside the refrigeration appliance through said hatch when said refrigeration appliance door is closed and said dispenser door is open.

11. The refrigeration appliance according to claim 1, wherein said dispenser door includes a thermally insulating material.

12. The refrigeration appliance according to claim 1, wherein said drink dispenser device has at least one dispensing element for dispensing a drink.

13. The refrigeration appliance according to claim 12, wherein said drink dispenser device includes a retaining element for accommodating a drink receptacle.

14. The refrigeration appliance according to claim 12, wherein said dispensing element includes an activation element for initiating dispensing of a drink, and said dispensing element is configured to dispense a drink upon actuation of said activation element.

15. The refrigeration appliance according to claim 1, which further comprises a storage container for accommodating a drink, a liquid or ice, said storage container being connected to said drink dispenser device by a dispensing line.

16. The refrigeration appliance according to claim 1, which further comprises a feed line for feeding a drink from outside the refrigeration appliance to said drink dispenser device.

17. The refrigeration appliance according to claim 2, wherein said refrigeration appliance door includes a lighting unit for illuminating said dispenser area, said lighting unit being integrated into said at least partially translucent section of said dispenser door or at least partially surrounding said at least partially translucent section.

18. The refrigeration appliance according to claim 17, wherein said lighting unit includes an LED-layer or an OLED-layer.

19. The refrigeration appliance according to claim 1, which further comprises an interior lighting unit for illuminating said refrigerated inner space, said dispenser area having at least one further translucent section disposed towards said refrigerated inner space for illuminating said dispenser area by using said interior lighting unit.

* * * * *